US007349549B2

(12) United States Patent
Bächler et al.

(10) Patent No.: US 7,349,549 B2
(45) Date of Patent: Mar. 25, 2008

(54) METHOD TO LOG DATA IN A HEARING DEVICE AS WELL AS A HEARING DEVICE

(75) Inventors: Herbert Bächler, Meilen (CH); Volker Kühnel, Männedorf (CH); Silvia Allegro, Unterägeri (CH); Stefan Daniel Menzl, Jona (CH); Hilmar Meier, Zürich (CH); Michael Boretzki, Rüti (CH); Stefan Launer, Zürich (CH); Ivo Hasler, Winterthur (CH); Hans-Ueli Roeck, Hombrechtikon (CH); Christoph Widmer, Wernetshausen (CH)

(73) Assignee: Phonak AG, Stafa (CH)

( * ) Notice: Subject to any disclaimer, the term of this patent is extended or adjusted under 35 U.S.C. 154(b) by 611 days.

(21) Appl. No.: 10/765,250

(22) Filed: Jan. 27, 2004

(65) Prior Publication Data

US 2004/0190739 A1 Sep. 30, 2004

Related U.S. Application Data

(63) Continuation-in-part of application No. 10/396,058, filed on Mar. 25, 2003, now abandoned.

(51) Int. Cl.
*H04R 25/00* (2006.01)

(52) U.S. Cl. ..... 381/314; 381/323

(58) Field of Classification Search ..... 381/60, 381/314, 315, 23.1, 312; 702/57
See application file for complete search history.

(56) References Cited

U.S. PATENT DOCUMENTS 4,972,487 A * 11/1990 Mangold et al. ..... 381/315
5,794,201 A 8/1998 Nejime et al.
6,118,877 A 9/2000 Lindemann et al.
2002/0071582 A1* 6/2002 Troelsen et al. ..... 381/314
2003/0138109 A1* 7/2003 Binder et al. ..... 381/60
2004/0066944 A1* 4/2004 Leenen et al. ..... 381/314

FOREIGN PATENT DOCUMENTS

EP 0 335 542 A2 10/1989
EP 1 206 163 A1 5/2002
WO 00/41440 A 7/2000

* cited by examiner

*Primary Examiner*—Brian Ensey
(74) *Attorney, Agent, or Firm*—Pearne & Gordon LLP

(57) ABSTRACT

The present invention relates to a method for recording information in a hearing device and/or in a recording unit at least temporally operationally connected to the hearing device. The method consists in that a point in time of the recording and/or a recording frequency as well as the information to be recorded, as data and/or parameters and/or adjustments of the hearing device are adjusted freely or are programmable, respectively. Furthermore, a hearing device is described that is suitable to use the method. By the present invention, a multitude of the parameters being adjustable in a hearing device can be checked or surveyed all together or selectively in real, i.e. actually existing acoustic environments in order to optimally adjust or adapt the hearing device afterwards, that means after the analysis by the fitter, for example.

28 Claims, 1 Drawing Sheet

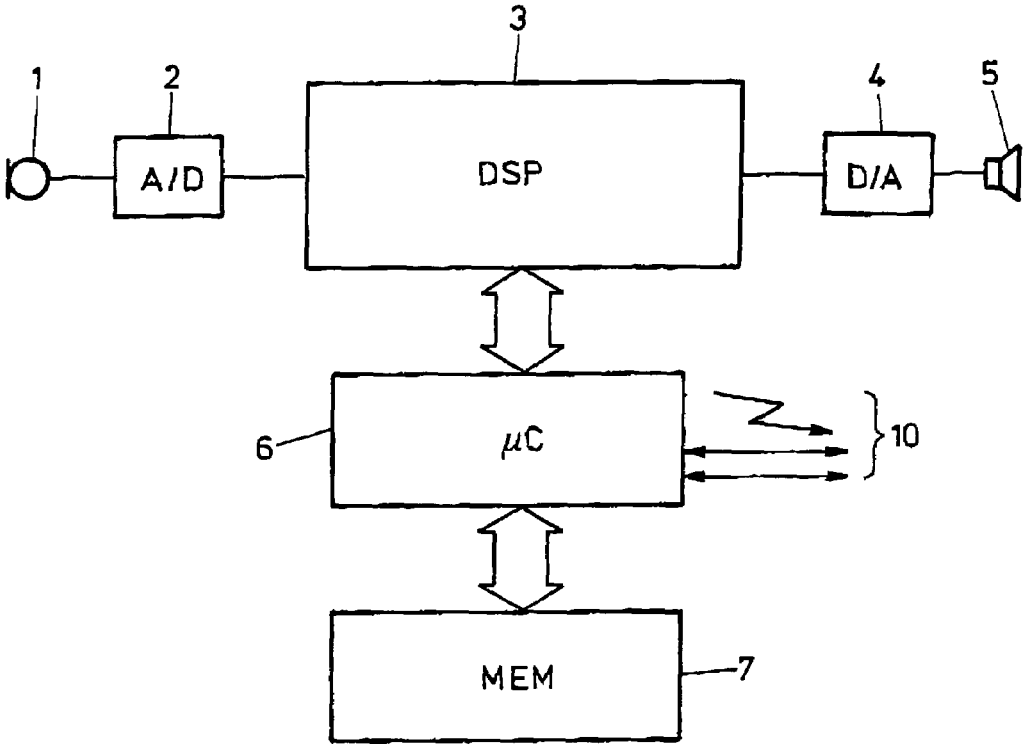
3
1
2
4
5
A/D
DSP
D/A
6
μC
10
MEM
7

METHOD TO LOG DATA IN A HEARING DEVICE AS WELL AS A HEARING DEVICE

TECHNICAL FIELD OF THE INVENTION

The present invention relates to a method to log data in a hearing device or in a recording device at least partially connected to the hearing device as well as a hearing device.

BACKGROUND OF THE INVENTION

Today's hearing devices are adjusted to the individual needs of hearing device users. The most important adjustment when used in the medical area lies therein that the hearing device can compensate or correct a hearing impairment of a patient. Therefore, an audiogram, for example, is established of the patient based on which audiogram different adjustments are made in the hearing device. Furthermore, today's hearing devices offer the possibility to select one of several hearing programs available in the hearing device in an automatic or manual manner. Thereby, the possibility is created for the hearing device user to adjust his hearing device to different acoustic situations in a best possible way.

The many and diverse adjustment possibilities, being either manually or automatically, give often raise, on the other hand, to confusions of the hearing device user, because it is difficult for the inexperienced hearing device user, on the one hand, to select the correct adjustments, on the other hand, an automatic selection of the hearing program can often not be comprehended by the hearing device user.

For this reason, it has already been proposed to record certain data in the hearing device, which data allow to analyze occurred acoustic situations afterwards. In this connections reference is made to U.S. Pat. No. 4,972,487, wherein a hearing device is described that has a memory unit in which the following data can be recorded:

Number of hearing program changes;

How many times a particular hearing program has been used, the selected hearing program being used for a minimal amount of time; and How long each of the possible hearing programs has been active.

Furthermore, reference is made to U.S. Pat. No. 5,210,803. In this printing a hearing device is also described with a memory unit. Though, and in contrast to the first mentioned printing, the memory unit is being used to save certain characteristics of the hearing device based on which the hearing device can be identified unambiguously. It is pointed out that certain information is already saved during the manufacturing of the hearing device, as e.g. the manufacturing company or technical data, as e.g. the adjusted gain.

For the sake of completeness, reference is made to a further known information recording variation, which is described in WO 00/41 440. As for the above-mentioned state of the art, this known teaching is also dealing of a hearing device with a memory unit to record information during operation of the hearing device. The information being recorded is limited to register the time during which the hearing device is being used. Therewith, the possibility is created to charge the actual use of the hearing device to the user. Furthermore, it is proposed that certain characteristics of the hearing device can only be used in a limited manner, once a preset time has been reached. An elimination of such limitations can only be reached by paying a fee.

Furthermore, reference is made to EP-1 206 163 A1, in which the already mentioned state of the art is again described.

It has been shown that all the known methods to record information are not sufficiently flexible to explain the actual reason for an erroneous adjustment or for an automatic adjustment being unexpected for the hearing device user in order that this adjustment can be corrected in the following. Fact is that there exists an extremely large diversity of possible causes for an erroneous behavior of a hearing device. This cannot be satisfactorily handled by the known methods. As a result thereof, the adaptation process according to the known information recording methods is extremely lavish and time-consuming.

It is therefore the object of the present invention to provide a method for recording information in a hearing device and/or in a recording unit operationally connected at least partially to the hearing device, which method allows complete investigation of possible erroneous adjustments or of adjustments being unexpected for the hearing device user in certain situations. It is a further object of the present invention to obtain maximum support for these adjustments of a hearing device in order to simplify the adjustment or fitting process.

SUMMARY OF THE INVENTION

The present invention relates to a method for recording information in a hearing device and/or in a recording unit at least temporarily operationally connected to the hearing device. The method consists in that a point in time of the recording and/or a recording frequency as well as the information to be recorded, as data and/or parameters and/or adjustments of the hearing device are adjusted freely or are programmable, respectively. Furthermore, a hearing device is described that is suitable to use the method. By the present invention, a multitude of the parameters being adjustable in a hearing device can be checked or surveyed all together or selectively in real, i.e. actually existing acoustic environments in order to optimally adjust or adapt the hearing device afterwards, that means after the analysis by the fitter, for example.

The present invention has the following advantages: By freely adjusting or programming a beginning of the information recording as well as the information being recorded, such as data and/or parameters and/or adjustments of the hearing device, the adjustment of a hearing device is for the first time possible in an optimal manner to the individual desire and the individual hearing impairment of a hearing device user. Thereby, the multitude of the parameters being adjustable in a hearing device can be checked or surveyed all together or selectively in real, i.e. actually existing acoustic environments in order to optimally adjust or adapt the hearing device afterwards, that means after the analysis by the fitter, for example. Because of the multitude of the parameters being possibly adjustable, the selective recording according to the present invention is most important. Thus, it is not possible to record all possible parameters and other adjustments of a hearing device at all times and always, because there is only limited available memory space as well as available energy in the hearing device.

Even after an adjustment of the hearing device by a fitter, the actual parameter adjustments may not necessarily be sufficient in order to cope optimally with the multitude of possible situations. It is therefore decisive, as realized by the present invention, that the fitter obtains an image of the momentary acoustic surrounding situation together with other relevant information, as e.g. information regarding the occurrence of signal feedback.

In addition, known solutions do not offer the possibility to use the information recording for a hardware diagnosis of the hearing device as it is the case e.g. in connection with microphone matching, changing the microphone sensibility, etc. The fitter can, by applying the present invention, clearly improve the hearing device service and can provide any necessary adaptation significantly faster. Thereby, he can in particular use the knowledge of the hardware state of the hearing device.

It is pointed out that the present invention cannot only be used for hearing devices—whether they are behind the ear, in the ear canal or implanted—for the compensation or correction of a hearing impairment. The present invention can rather be applied for any hearing aid which is used to improve communication.

BRIEF DESCRIPTION OF A DRAWING

The present invention will be further explained by referring to a drawing showing an exemplified embodiment. Thereby, the only FIGURE shows a block diagram of a hearing device according to the present invention.

DETAILED DESCRIPTION OF EMBODIMENTS OF THE INVENTION

The only FIGURE shows, in a schematic representation, a hearing device consisting of a microphone 1, a signal processing unit 3 and a loudspeaker unit 5, which is often called receiver, the microphone 1 as well as the loudspeaker unit 5 being operationally connected to the signal processing unit 3. In case the implementation of the signal processing in the hearing device is realized by digital technology, as it can be seen from the FIGURE, an analog-to-digital converter 2 is provided between the microphone 1 and the signal processing unit 3, and a digital-to-analog converter 4 is provided between the signal processing unit 3 and the loudspeaker unit 5.

It is pointed out that, although only a single microphone is represented in the FIGURE, the use of several microphones is feasible, as it is e.g. provided for the "beam former" technology. Furthermore, the present invention is in particular suitable for binaural hearing devices which comprise two hearing device parts being either connected by a wired or a wireless link.

Furthermore, a control unit 6 is contained in the hearing device, which control unit 6 is operationally connected, on the one hand, to the signal processing unit 3 and, on the other hand, to a memory unit 7. In addition, a further embodiment of the present invention consists in that a communication takes place via a connecting device 10 with an external processing unit, which is arranged outside of the hearing device. The connecting unit 10 can either support a wired or a wireless data transfer.

With the aid of the exemplified structure of a hearing device represented in the FIGURE, a multitude of parameters and information can be recorded in the memory unit 7, the parameters and information being grouped as follows:

- hardware data, i.e. essentially the configuration of a hearing device;
- customer-specific data;
- information of the fitting history of a hearing device;
- operating data or current adjustments or time signals;
- statistical data.

According to the present invention, information of a single as well as information of several of the aforementioned information groups can be recorded in the memory unit 7 or in a processing unit which is externally positioned regarding the hearing device or in an external memory unit.

Hardware data being recorded can, for example, be the following:

Specification of vent, hook, microphone, receiver, tubing, shells, hearing device types and embodiments, right or left hearing device part of a binaural hearing device, switch at the hearing device, manufacturing data as serial number, manufacturing date, identification features of the electronics being used, version of the (Digital Signal Processing)—DSP—firmware, version of the DSP algorithms, version of the used fitting software, version of the used data recording software, version of the control unit, maximum gain, delay over the signal feedback path, microphone matching, sound variation data, hearing device variation data, hearing device user interaction data, etc.

For a binaural hearing device that consists of two hearing device parts which are connected to each other either over a wired or a wireless link, it is provided according to a further embodiment of the present invention to monitor and record the quality of the link, thereby using, for example, three levels for the link quality. For example: "Connection not available", "poor connection" or "good connection". For a characterization of the link into different quality levels, only the quality levels are naturally recorded as a function of time.

By the present invention, the possibility is created to use data logging for a hardware diagnosis for the first time, as it can be used, for example, in the case of microphone matching, change of microphone sensitivity, etc. The fitter can significantly improve the hearing device service by the present invention and can provide necessary adjustments significantly faster. Thereto, the knowledge of the state of the hardware can particularly be used. As an example, the use of data logging is mentioned in the following to gather information regarding the state of a so-called wind and weather protection which is placed over a microphone opening as a sound-transparent cover:

If a cover used for a hearing device as a wind and weather protection gets dirty, the transfer characteristics of the cover will change. As a result thereof, a strong attenuation is formed for the sound in particular for high frequency components. These frequency components do not get into the hearing device at all and therefore also not to the hearing device user. As a result thereof, the comprehensibility of the hearing device user decreases even with the hearing device, or the hearing device does not work properly any more, respectively.

A very simple action to improve matters is to exchange the cover used as wind and weather protection by the fitter (or by the hearing device user himself).

The cover must be exchanged, dependent on the use of the hearing device, every two to six months by a new cover. This can be accomplished by the fitter in a simple manner. Unfortunately, the problem of a "dirty cover" is very often not recognized by the fitter, and the hearing device is unnecessarily sent back to the manufacturer for service. This procedure is expensive and causes a waste of service capabilities. In addition, the hearing device user has no hearing device available during this time.

The present invention is now used to monitor the state of the cover internally, and—if need be—to generate a corresponding information or instructions to the hearing device user, respectively (as for example an acoustic message "Please consult your fitter!"). As soon as the fitter connects the hearing device to the fitting software, a corresponding message appears on his monitor, saying, for example, "Please replace the cover!". In order to be able to monitor the state of the cover, the mean spectral distribution can be logged in the sense of the present invention, for example. As soon as high frequencies of a predefined high frequency band drops below a critical threshold, the message as mentioned above will be generated for the hearing device user or the fitter, respectively. The critical threshold can thereby be determined adaptively by logging the mean spectral distribution during the initial operation phase (e.g. during the first 100 hour of operation). This mean spectral distribution is then saved as reference.

For further information regarding a cover for a wind and weather protection, reference is made to EP-0 847 227.

With the aid of the hardware data, the fitter can therefore refine his judgment of the hearing device, which gives him the possibility to detect possible hardware damage in a short time.

Custom-specific data are, for example, the following: diagnostic data (audiogram, ear impedance, etc.); anatomic data (concha and ear canal) which can be produced by an ear imprint, and directly derived therefrom are modeled physical quantities as for example RECD (Real Ear to Coupler Difference), OEG (Open Ear Gain), etc.

By the present invention the logging of the fitting history of a hearing device has been realized for the first time. Thereby, the fitting parameters or the changes in regard to the factory set adjustment as well as the place of the fitting, the date of the fitting and the program version of the fitting software are saved. The knowledge of this information is very advantageous, because it can be taken into account in a new fitting process. As a result thereof, a new fitting is simplified and shortened and always leads to a better result. In addition, it can be used to the understanding and for documentation of the whole "patient history" or the fitting history of the hearing device, respectively, from which again conclusions to the hearing device user or his habits can be reached. The fitter has now the possibility to follow the preferences and desires of his client over several years and can therefore better serve each client individually.

Besides the current adjustments, which can be, for example, information on the hearing program, settings of used filters, identified momentary surrounding situations etc., the present invention also allows to log so-called operating data, which are, for example, acoustic signals itself recorded by the microphone 1, the registration of the manipulation of a switch integrated into the hearing device or the stimuli submitted to a hearing device user in the form of an acoustic signal or in the form of a direct stimuli of the inner ear, as it is the case in connection with implantable hearing devices. For example, a change of the loudness is logged which is adjusted by the hearing device user in a certain acoustic situation. From now on—for example for repeated changes of the loudness in the same manner and for the same hearing program—, each time the same hearing program is selected, the loudness is changed by the predetermined amount. Therefore and according to a further embodiment of the present invention, possible interactions of the hearing device user are logged and interpreted similarly as has just been explained in connection with the change of the loudness each time the corresponding hearing program is selected.

In a further embodiment of the present invention, the hearing device can be switched off in such a way that the corrected sets of parameters, which have been changed according to a hearing wish of the hearing device user as explained above, are saved in the hearing device. In case it turns out that the hearing device user always adjusts the originally saved parameter set in the same manner for a certain acoustic situation, i.e. in the same direction and for the same measure, the originally saved parameter set or the originally saved values, respectively, can be exchanged by the amended parameter set or values, respectively. The corrected parameter set or the corrected values, respectively, are used from now on as standard adjustment.

This exchange of the originally saved parameter set or values, respectively, by corrected parameter sets or corrected values, respectively, can automatically be learned by the hearing device itself—for example by using a neural network—, or it can be carried out by the fitter (dispenser) or by the hearing device user himself.

In this connection, an embodiment is conceivable for which the mentioned automatic adjustment is preset by the fitter, i.e. the fitter defines together with the hearing device user, whether several manually made adjustments are automatically added to the initial adjustment or whether the amendments are only logged and possibly added to the initial adjustments after discussions took place between the fitter and the hearing device user during the next adjustment process.

Naturally, a large amount of data accumulates while recording acoustic signals so that a recording of such data is only possible in external memory due to the limited memory size of the memory unit 7 provided in the hearing device at the time the invention was made. As a result thereof, the hearing device must be connected to an external memory unit over the connecting unit 10 in this case. Limitations also result for a permanent recording of a large amount of data by the limited amount of energy in a hearing device, Accordingly, energy must be supplied to the hearing device for a permanent data recording in the internal memory unit 7.

In addition, a storing of statistical data, as e.g. the amplitude percentile,—or general spatial or spectral level distribution, acoustic characteristics over an adjustable time interval, sound type distribution, sound type adjustment distribution, etc.—is possible. Percentiles correspond to an "amplitude" sorting of signals, and are used e.g. to differentiate situations. Percentiles or percentile generators, respectively, are described in EP-0 732 036, for example.

The advantage of data recording of statistical data lies in a reduced memory size needed compared to the storing of not processed raw data.

For example, events will be counted during data logging according to the present invention and/or gliding mean values are calculated. Thereby, the interaction between the hearing device user and the hearing device is depicted between two fitting sessions which are carried out by the fitter.

In case that the two fitting sessions lie far apart, the last three to four weeks have a little influence on the mean value; in other words, the time before the three to four weeks is weighted stronger. This does not correspond to the perception of the hearing device user which primarily remembers the behavior in the last days or the last week, respectively.

A further embodiment of the present invention consists in that no current mean values and events are logged but they will be deleted such that the effect of the values or events decreases in the course of time. Such algorithms are called "Leaky Averager".

The procedure will be further explained on the basis of the calculation of a mean value: In general, the sum of the logged values and the number of values are saved. For each new measurement, the new value is added to the sum, and the number of values is incremented at the same time. The mean value can then be calculated by dividing the sum by the number of values.

For the proposed method, the same procedure is applied in general but the sum and the number of values are multiplied by a factor between zero and one, preferably close to one, in regular intervals. Thereby, the mean value is not changed but the weight of the older measurements will decrease compared to the younger measurements. As a result, a time-weighted statistic is obtained as desired which better corresponds to the perception of the hearing device user than the gliding unweighted calculation of statistic values.

In further embodiments of the present invention, so-called leaky integrators are provided to obtain time-weighted statistic values in the hearing device. Thereto, the calculation of mean values, histograms, variances and standard deviations are carried out, for example.

By a consequent use of this kind of statistics, the perception of a hearing device user is better taken into account in the data logging according to the present invention, and the evaluation of the results of data logging is fundamentally simplified for the fitter.

For all the aforementioned embodiments, the possibility exists, as option, to log the date and the time in the memory unit 7. In this connection, a further problem arises in that, for each interruption of the power supply, e.g. by switching off the hearing device during the night, the date as well as the time is lost. For this reason, it is proposed to transfer the current date and the current time from outside to the hearing device in regular intervals or by enquiry by the hearing device. Thereby, one or a combination of the following external synchronization units can be used:

- An intelligent remote control, which is used for example to adjust certain parameters of the hearing device as e.g. gain or the like;
- Computer, mobile telephones, PDA (Personal Digital Assistant) or other electronic devices by which desired information is transferred over Bluetooth, for example; and
- Radio signals which contain a time signal in the long wave range (atomic clock).

The aforementioned possibilities for time synchronization result in a further possibility to implement new applications in the hearing device, which are based on the availability of date and time. One such application consists in implementing an acoustic agenda, which acoustically indicates an up-coming appointment to the hearing device user. One possibility lies therein lo implement the agenda in the hearing device itself. In another embodiment, the relevant data are coming from an external device, e.g. a PDA, and are simply acoustically processed by the hearing device. Besides the pure appointment information from a separate agenda, it is further proposed to indicate the intake of medicine in an acoustic manner, which medicine must be taken at preset times and at preset intervals.

In a further embodiment of the present invention based on the time synchronization, it is provided to put computer programs at disposal, which process corresponding actions based on one or several of the following factors:

- Given time of day;
- Given dates;
- Working day or given working day, respectively;
- Given holiday.

For this embodiment of the present invention, the possibility consists in selecting a hearing program automatically, for example at a normal working day, which hearing program takes into account the acoustic surround situation normally predominating at the working place of the hearing device user, while processing the relevant acoustic signals in a best possible way.

The mentioned computer programs can either be implemented in the hearing device or in an external device, as for example a PDA (Personal Digital Assistant). For an implementation in the hearing device as well as in an external device, synchronization processes can be provided in a known manner to match the relevant information between the partitioning devices. Therewith, the aspect of increased data security has also been taken into account.

For visually handicapped people, the possibility opens up in a further embodiment of the present invention in addition by implementing an acoustic watch in the hearing device.

In a further embodiment of the present invention, it is provided that a watch is contained in the hearing device in order to measure the absolute time or in order to generate a time stamp. The further aspects of the present invention can be realized conveying the same general sense.

It is expressly pointed out that the aspect of the time synchronization is not limited to the use of data logging in or through a hearing device but can be used independently therefrom.

As mentioned before, the selection of the data to be recorded is freely programmable. Thereby, two advantages can be obtained first:

First, only the maximum necessary number of parameters must be saved because of the limited battery and memory capacity. Second, the registration of, for example, feedback situation can require other parameters than the registration of an automatic hearing program switching. Different situations can be registered authentically by the memorization of the most important parameters. In order to reach a best possible adjustment of the hearing device, the fitter decides individually for each hearing device user which of the parameters to be memorized represents the best combination in order to improve the next fitting process. By a corresponding programming, it is possible to change the data or parameters to be logged during operation. So, it can, for example, be useful that, while the first hearing program is running, the gain is logged. If a switching to a second hearing program is taking place, other information, e.g. components of surrounding noise, must be logged. A further aspect of the present invention relates to the triggering of the data or information logging, respectively, i.e. the point in time from which data or information, respectively, must be logged.

In this connection, it is pointed out that U.S. Pat. No. 4,972,487 discloses the logging of data after a change of hearing program. But this process is fixed to the corresponding event and cannot be changed.

In this connection, the present invention is characterized in that the event relevant for data logging is selectable freely, either be it by manually triggering, which is performed, for example, by the hearing device user himself, or be it by a programmed triggering, for which different preset conditions must be met.

For manual triggering, the data logging is manually triggered by the hearing device user or by the fitter, for example by pressing a button on the remote control or on the hearing device. Thereby, the hearing device user can decide which situation is logged in order to prove e.g. which situations cause difficulties to him and how the situations are presented to him. In order to register the complex situations as completely as possible, the duration of data logging is also freely adjustable. The fitter, responsible for the fitting, is therewith no longer relying on artificial lab situations but he can directly reconstruct the behavior of the hearing device in the situations perceived as critical by the hearing device user and can make improvements during a new fitting.

In a further embodiment of the present invention, a periodic data logging is provided (so-called frequency triggering). The interval, i.e. the trigger frequency, is adjustable or is alterable automatically according to a pre-settable programmable pattern. By the variation of trigger frequency and of the dana logging length, the memory space used to log the data is reduced and the logging frequency can be adapted to the parameter being logged. The data logged over a longer time frame thereby gives an overall picture of the acoustic situation surrounding the hearing device user as well as the corresponding adjustment of the hearing device. By this information, the fitter can better adapt all adjustments of the hearing device and can particularly adapt to the hearing device user individually.

In a further embodiment of the present invention, the data logging takes place automatically, to be precise, for example, by certain characteristics of the acoustic surrounding (e.g. if a certain loudness, signal-to-noise ratio, etc. is reached or is exceeded, respectively) or by certain characteristics of the hearing device as automatic program switching or the occurrence of feedback. Therefore, one speaks of event-driven data logging. The actual trigger event is, according to the invention, freely selectable and can be different from one hearing device user to another. If, for example, an automatic program switching is unpleasant for a hearing device user in a certain situation, the fitter can use exactly this program switching as trigger event. By the logging of data at the occurrence of the event, the acoustic scenes are then logged as, if need be, also the adjustments of the hearing device. The fitter can then provide a better adjustment of the hearing device after the analysis of the data so that the undesired automatic program switching in the hearing device does not occur anymore in the future.

For the developer of hearing devices, this procedure results in the additional advantage that the selection of the automatic operation condition can be checked and controlled under real acoustic surroundings.

For all of the described embodiments, a memory unit is provided either within the hearing device and/or it is provided an external memory in which the data or information, respectively, are logged. In this connection, it is provided in a further embodiment of the present invention to partition the memory unit and/or the external memory into two or several sectors. In each sector, function-specific information or time-specific information are saved.

In a preferred embodiment, the memory unit and/or the external memory are partitioned into three sectors, the sectors being called single sector, append sector and overwrite sector.

In the single sector, data is logged during the whole lifetime of a hearing device. The recording of, for example, production data as microphone type, receiver or loudspeaker type, etc. is meaningful. This sector of the memory unit or the external memory cannot be deleted.

In the append sector or continuous sector, the information being recorded is always appended to the last saved data. The memory unit or the external memory is thus filled from the beginning to the end successively with the newest data. By using this procedure, the fitting history of the hearing device can, for example, be logged over a very long period. Also this sector cannot be deleted, but can be overwritten in contrast to the single sector.

Finally, the overwrite sector can be used for logging data, which occurs during operation. After the data logging has taken place for a certain period based on certain events, the data will not be used anymore after an interpretation has taken place. The fitter or the hearing device user frees the memory space again, for example, by a suitable manipulation at the remote control, at the hearing device or by a connected programming and reading unit. The sector can therefore be overwritten after the interpretation of the data. So it is, for instance, feasible that the hearing device user wants to record a certain situation by data logging but was not yet satisfied by the situations logged so far because the situations did not have the expected loudness, or no feedback occurred. In this case, it is possible to delete the saved data again. Therewith, free memory space is again created for logging new data.

The overwrite sector is in particular suitable for recording the gain, the signal feedback, program switching or for acoustic signals.

In a further embodiment, the overwrite sector is realized as circular buffer in which the oldest data is overwritten by the youngest data. Accordingly, it is not necessary to delete this overwrite sector because the old data is automatically deleted within the bounds of the necessary memory space by the process of overwriting.

As in all information processing systems in which data is saved and in which energy supply interruptions lead to a data loss, the danger always exists for hearing devices with data logging capabilities in the meaning of the present invention that logged data will be corrupted in the memory unit if an energy supply interruption occurs, for example due to a removal of the battery from the hearing device by the hearing device user, while data logging is taking place. For this reason, is has already been proposed to log data in different memory sections of the memory unit, i.e. to log the same data several times while at the same time to especially mark the memory section with the most current data. Regarding the known teaching, reference is made, for example, to EP-1 206 163 A1. It is obvious that also the data logging process used in general purpose information processing systems, which contain measures to safely write and read data while an interruption of the supply of power occurs, is best suitable to prevent corrupted data in the memory unit. In this connection, reference is made to known information handling procedures which are known under the name RAID (Redundant Arrays of Inexpensive Disks), NTFS (Windows NT File System) and FAT (File Allocation Table). These known information handling procedures can very well be implemented in the central processing unit of a hearing device or in the corresponding software, respectively.

When logging data, the high consumption of energy must be observed, to be precise in particular when logging data in the memory unit 7 of the hearing device is performed, because it quickly results in a very fast discharge of the battery in the hearing device due to the limited energy available.

A write cycle normally lasts for approx. 4 to 8 ms and is therefore also called "burst". During the write cycle, a high load of the battery occurs and therewith most often also hearable artifacts in the hearing device because as a result of the write cycle a short-time voltage reduction is generated which results in an insufficient supply of the microphones, the amplifiers, etc. In order to prevent the generated artifacts, the following strategies are proposed in the boundaries of this invention.

It is expressly emphasized that the following measures are not only suitable for recording information in connection with the above explanations, but the following explanations have a general meaning while writing to a non-volatile memory in portable devices and can therefore be seen as independent invention:

A first variation is characterized in that, for the data logging, a favorable point in time must be awaited. Thereto, the information are first saved in a volatile memory and afterwards transferred to a non-volatile data memory, when the most favorable point in time is reached. A favorable point in time is, for example, reached then when the battery is only loaded slightly or when only little signal components must be generated at the output.

The second variation intends that, during the write cycle, the gain is increased in advance in such a way that a voltage drop due to the write cycle is compensated; therefore no recognizable change is observable at the output signal of the hearing device during a write cycle.

By a third variation, it is provided to use a kind of signal processing through which the hearable artifacts generated by the data recording are suppressed. The noise generated by a burst can be determined individually for each hearing device already in the developing phase and can be eliminated with the aid of a suitable signal processing program. For example, noise signals generated by the logging process can be eliminated with the aid of a filter. As another example, the logging of data can be carried out in data packets, such that a repeat rate for the recording of data packets does not exceed a predefined repeat rate.

Finally, a fourth variation is proposed. It is concerned with the limitation of the frequency of write cycles. It has actually been recognized that the hearable artifacts are depending on the repeat rate of the write cycles. A maximum repeat rate is therefore set to a value at which just no hearable artifacts occur. This maximum admissible repeat rate is thereby in particular dependent on the hearing device type, the battery type, battery status and/or the memory type being used.

The access to the memory unit 7 to read and to program is done by suitable hardware over the connecting unit 10 shown in the FIGURE, the possibility consisting in transferring the saved data to the memory of a (Personal Digital Assistant)-PDA or to the memory of a mobile telephone. In such a device, the transferred data can either be directly processed or can be transferred to a powerful processor for further processing at a later point in time.

In a further embodiment, it is provided that the information is directly transferred to a powerful external processor by bypassing the memory unit 7 in the hearing device in order to provide a visualization of the information on the external processor, for example.

Therewith, a good control possibility is particularly provided for the fitter.

In this connection, a particularly advantageous embodiment of the present invention is mentioned for which a linking to the mentioned external processor via the internet is proposed. The responsible fitter, who can take action on the same external processor, analyses the data and adjusts, if need be, the configuration of the hearing device, or invites the hearing device user for an additional fitting session in which a change in configuration can be carried out in the hearing device. This new use of the present invention can be called "Remote Performance Monitoring".

The interpretation of the data saved in the memory unit 7 during operation allows the adaptation of the hearing device. In a further embodiment, it is provided that the hearing device user can gradually adapt to the new hearing device setting. So, the possibility is given, for example, to increase the gain in the hearing device after a certain operation lime automatically until a desired value is reached finally. An important application thereof is related to those people that must first get acquainted to the wearing of a hearing device. A sudden improved acoustical perception due to a hearing device, being used for the first time and being optimally adapted to a hearing loss in view of the responsible fitter, results in a strong irritation of the hearing device user according to experience. If the hearing ability instantly improves by a first wearing of a hearing device, the hearing device user will perceive this as unpleasant or even as tiresome. A slow increase of the hearing device influence reduces this negative perception to a great extent and results in higher general acceptance of wearing a hearing device.

In the publication of the international patent application WO 01/26 419 A1, a method to acclimatize a hearing device user to a hearing device is described. The known method consists in that the fitter does not immediately adjust to the aspired gain but first to a reduced value compared to the aspired gain, and that the current gain is continuously increased during a preset time interval until the aspired gain is reached. This so-called acclimatization phase is completed when the final gain—or a final value for another parameter—is reached. Therewith, a soft acclimatization of the hearing device user to the hearing device is obtained. Though, the fitter must be consulted for a change in the current adjustment.

Therefore, it is proposed to further improve the fitting procedure in that the hearing device user himself takes part in the acclimatization procedure. The participation of the hearing device user consists in particular in that the acclimatization procedure is a interactive procedure instead of an automatic and preset acclimatization procedure as has been described in WO 01/26 419 A1.

According to the present invention, it is intended that the hearing device user initializes and controls the acclimatization procedure in that, for example, the gain or another parameter is adjusted by the hearing device user.

Many different interactions by the hearing device user are conceivable during the acclimatization phase. Of these interactions, the following two interactions are described for the sake of illustration:

The hearing device is put into an "acclimatization mode" by the fitter, for example, for three months. In this mode, amplification (loudness), which has been adjusted by the hearing device user, will be used as standard adjustment immediately or after the hearing device has been switched off and on again.

In the hearing device, certain actions or interactions, respectively, are logged in the manner as described above. A new adjustment will become a standard adjustment as soon as a preset number of actions or interactions, respectively, has been recorded or logged. Therewith, several parameters of the hearing device can be adjusted. In particular, the amplification (or gain) can specifically be changed, i.e. adjusted, over the whole bandwidth or transfer function.

The present invention or the diverse aspects of the present invention for data logging allow a number of further applications. The hearing devices used today have a high grade of complexity which in particular result in that a high number of parameters and therewith a high number of different hearing programs can or must be adjusted. These adjustment possibilities cannot easily be fitted to the hearing habit of a hearing device user. Therefore, it is proposed in a further aspect of the present invention that the hearing device is exposed to different acoustic situations during a trial phase and that the signals or parameters and information generated internally and/or externally are logged according to the above-mentioned procedure. As result thereof, the Sitter can thereafter refer to a number of very important information which applies to the effective acoustic surround situation of the hearing device user. In particular, the following possibilities can be used by the fitter;

From the logged data, the fitter can conclude the optimal gain adjustments for all selectable hearing programs. If, for example, it is a habit of the hearing device user to spend a lot of time in his car, the corresponding hearing program will be saved as main or standard hearing program. Accordingly, the gain is reduced.

From the logged data, the fitter can adjust the function of the classifier which determines the momentary acoustic situation. This in particular includes the sensitivity and the time delay, the latter being the delay of a change from one hearing program to another.

According to the logged data, the fitter can perform a fine tuning for the single acoustic situations or hearing programs, respectively. This in particular includes adjustments made in connection with the sound and presentation level. In other words, the sound, hearable for the hearing device user, can therewith be influenced which sound forms an important part of a normal hearing.

Based on the logged data, the fitter can select the relevant hearing programs for the corresponding hearing device user.

Independent on the above-said, a further embodiment of the present invention consists in that the described data logging in the hearing device is used to log the "acoustic world" of the further hearing device user. Therefore, it is not intended that the hearing device processes an acoustic signal for the hearing device user. The only aim is to log the acoustic situation with which the future hearing device user is usually confronted in his environment. Such a pre-evaluation can, for example, simplify the selection of a hearing device type.

The invention claimed is:

1. A method to log data in a hearing device and/or in a recording unit that is at least temporarily operationally connected to the hearing device, the method comprising the steps of adjusting or programming a point in time of the data logging and/or a logging frequency and/or the data to be logged, the data being at least one of parameters and adjustments of the hearing device, wherein at least one of a date and time unit is provided in the hearing device which data and/or time unit is being synchronized with an external synchronization unit, and wherein at least one of an acoustic signal and speech synthesized information is being generated in the hearing device based on previously set time or date information.

2. The method of claim 1, wherein the point in time for starting the data logging is triggered or changed either manually or event-driven.

3. The method of claim 1, further comprising the steps of processing the data before the logging and logging the processed data only.

4. The method of claim 1, wherein the data is arranged in one or several of the following categories:

Hardware data, including sound variation data, system behavior data and hearing device user interaction data;

Customer-specific data;

Data related to the fitting history of a hearing device;

Operating data or current adjustments or time signals;

Statistical data.

5. The method of claim 1, further comprising the step of using identical or similar adjustments corrected once or several times in certain acoustic situations as new standard adjustments.

6. The method of claim 1, wherein one or several of the following adjustment possibilities are used based on the logged data:

in case of a new adjustment in the hearing device, the desired adjustment comes into full effect after a preset time, the hearing device user being able to have influence on adjustment procedure;

the available hearing programs or parameters or operating adjustments, respectively, are rearranged;

a used classifier undergoes a fine tuning, sensitivity and time delay being particularly adjusted;

selectable hearing programs or parameters or operating adjustments are selected or activated, respectively.

7. The method of claim 1, wherein the data is logged in a memory unit which is located in the hearing device, a reduction of a supply voltage due to the logging process being compensated.

8. The method of claim 1, further comprising the step of eliminating noise signals generated by the logging process with the aid of a filter.

9. The method of claim 1, wherein the logging of data is carried out in data packets, a repeat rate for the recording of the data packets not exceeding a predefined repeat rate.

10. The method of claim 9, wherein the predefined repeat rate corresponds to a maximum value at which hearable artifacts just do not occur by the logging process.

11. The method of claim 1, wherein the information is recorded in at least one of the two sectors in the memory unit.

12. The method of claim 11, wherein the data is logged in at least one of the three sectors, data being logged in a first sector is neither deleted and nor appended, data being logged in a second sector is not deleted, new data being logged in the second sector being appended, and data having been logged in a third sector is deleted.

13. The method of claim 11, wherein the data is logged in at least one of three sectors, data being logged in a first sector is neither deleted and nor appended, data being logged in a second sector is saved in a circular buffer in which new data is logged at a location of the oldest data stored in the circular buffer, and data having been logged in a third sector is deleted.

14. The method of claim 1, wherein one or a combination of the following equipment is being used as the external synchronization unit:

remote control;

computer;

mobile telephone;

PDA;

atomic clock.

15. The method of claim 1, further comprising the steps of logging data in a memory unit which is located in the hearing device, a logging of data being only carried out if one or several of the following conditions are met:

a battery unit, supplying energy to the hearing device, has an output voltage that lies above a predefined value;

there exist no surround sound to be processed by the hearing device;

a mean level of surround noise is higher as a predefined level;

the amount of data to be logged is limited to a predefined value, for example to 128 bytes.

16. A hearing device comprising a signal processing unit, a control unit, a memory unit, at least one microphone, a loudspeaker unit, the at least one microphone and the loudspeaker unit being operationally connected to the signal processing unit which on its part being operationally connected to the memory unit over the control unit, wherein a point in time for at least one of the logging, a logging frequency, and the data to be logged are freely adjustable or programmable, respectively, wherein at least one of a date and time unit is provided in the hearing device which date and/or time unit is synchronizable with an external synchronization unit, and wherein at least one of an acoustic signal and speech synthesized information is generated in the hearing device based on previously set time or date information.

17. The hearing device of claim 16, wherein the data are savable in the memory unit.

18. The hearing device of claim 16, wherein the point in time for starting the data logging is triggered or changed either manually or event-driven.

19. The hearing device of claim 17, wherein the point in time for starting the data logging is triggered or changed either manually or event-driven.

20. The hearing device of claim 16, wherein the data is transferred to an external memory unit which is connected to the hearing device preferably via the internet.

21. The hearing device of claim 16, wherein the memory unit is partitioned into at least two sectors.

22. The hearing device of claim 21, wherein the data is logged in at least one of three sectors, the data being recordable in a first sector is not changeable, data being recordable in a second sector is not deleted, new data being recordable in the second sector is appended, and data being recordable in a third sector is deleted.

23. The hearing device of claim 21, wherein the data is recordable in at least one of three sectors, data being recordable in a first sector is neither deleted and nor appended, data being recordable in a second sector is savable in a circular buffer in which new data is recordable at a location of the oldest data stored in the circular buffer, and data being recordable in a third sector is deleted.

24. The hearing device of claim 16, wherein the data is arranged in one or several of the following categories:

Hardware data, including sound variation data, system behavior data and hearing device user interaction data;

Customer-specific data;

Data related to the fitting history of a hearing device;

Operating data or current adjustments or time signals;

Statistical data.

25. The hearing device of claim 16, wherein one or a combination of the following equipment is used as the external synchronization unit:

remote control;

computer;

mobile telephone;

PDA;

atomic clock.

26. The hearing device of claim 1, wherein preset actions are generated based on one or several of the following factors:

preset time of day;

preset date;

working day or preset working day, respectively;

holiday.

27. A binaural hearing device with at least two hearing device parts, at least one of the at least two hearing device parts are realized according to claim 16.

28. The hearing device of claim 27, wherein a quality of a connection between the at least two hearing device parts is monitored.

* * * * *